US007363676B1

(12) United States Patent
Habibi

(10) Patent No.: US 7,363,676 B1
(45) **Date of Patent: *Apr. 29, 2008**

(54) ADJUSTABLE DIAMETER CYLINDRICAL MECHANISM

(76) Inventor: Masood Habibi, P.O. Box 71104, Los Angeles, CA (US) 90071

( * ) Notice: Subject to any disclaimer, the term of this patent is extended or adjusted under 35 U.S.C. 154(b) by 668 days.

This patent is subject to a terminal disclaimer.

(21) Appl. No.: 10/827,905

(22) Filed: Apr. 19, 2004

Related U.S. Application Data

(63) Continuation-in-part of application No. 09/645,963, filed on Aug. 24, 2000, now Pat. No. 6,725,495.

(60) Provisional application No. 60/150,507, filed on Aug. 24, 1999.

(51) Int. Cl.
*A46B 9/02* (2006.01)
*A46B 9/10* (2006.01)
*A45D 24/00* (2006.01)

(52) U.S. Cl. ..... 15/160; 15/165; 15/169; 132/120

(58) Field of Classification Search ..... 15/72, 15/159.1, 160, 184, 104.19; 132/120, 226, 132/223, 245, 250, 262; 446/487, 124–126; 74/89.23, 424.71, 424.74; 411/413, 389, 411/32–34, 36; 135/37–39, 33.7, 98–99, 135/31

See application file for complete search history.

(56) References Cited

U.S. PATENT DOCUMENTS

| | | | | |
|---|---|---|---|---|
| 190,960 | A | 5/1877 | Davis | |
| 2,244,068 | A | 6/1941 | Kay | |
| 4,334,813 | A * | 6/1982 | Oettl | 411/68 |
| 5,020,552 | A | 6/1991 | Hollenberg et al. | |
| 5,212,366 | A | 5/1993 | McDougall | |
| 6,725,495 | B1 | 4/2004 | Habibi | |

* cited by examiner

*Primary Examiner*—Laura C Guidotti
(74) *Attorney, Agent, or Firm*—Thelen Reid Brown Raysman & Steiner LLP; David B. Ritchie

(57) ABSTRACT

A pair of foundations held on a central rod disposed along an axis secure a number of connecting rods which, in turn, support portions of a cylinder oriented parallel to the axis. As the angle between the connecting rods and the central rod is adjusted, the cylinder portions move toward and away from the central rod so as to vary the diameter of the adjustable diameter cylindrical mechanism.

13 Claims, 7 Drawing Sheets

ADJUSTABLE DIAMETER CYLINDRICAL MECHANISM

STATEMENT OF RELATED APPLICATIONS

This is a continuation-in-part of U.S. patent application Ser. No. 09/645,963, filed Aug. 24, 2000 (now U.S. Pat. No. 6,725,495, issued Apr. 27, 2004) in the name of inventor Masood Habibi, which, in turn, claims the benefit of U.S. Provisional Patent Application Ser. No. 60/150,507, filed Aug. 24, 1999.

FIELD OF THE INVENTION

The present invention is directed to an adjustable diameter cylindrical mechanism.

BACKGROUND OF THE INVENTION

Cylindrical hair brushes, curlers and other devices are popularly used for grooming hair. Many different such hairbrushes, curlers, and the like are available having different lengths of bristle and different diameters. Each suits a different purpose. It would be desirable to have a hairbrush capable of adjustment in diameter so that a single hairbrush could be used for a multitude of purposes. Similarly, adjustable diameter curlers would reduce the need for a large collection of fixed-diameter curlers.

The present invention addresses this and other problems. These and other features and advantages of the present invention will be presented in more detail in the following specification of the invention and in the associated figures.

BRIEF DESCRIPTION OF THE INVENTION

A pair of foundations held on a central rod disposed along an axis secure a number of connecting rods which, in turn, support portions of a cylinder oriented parallel to the axis. As the angle between the connecting rods and the central rod is adjusted, the cylinder portions move toward and away from the central rod so as to vary the diameter of the adjustable diameter cylindrical mechanism.

BRIEF DESCRIPTION OF THE DRAWINGS

The accompanying drawings, which are incorporated in and constitute a part of this specification, illustrate an embodiment of the invention and, together with the present description, serve to explain the principles of the invention.

In the drawings.

DETAILED DESCRIPTION

Embodiments of the present invention are described herein in the context of a an adjustable diameter cylindrical mechanism. Some of those embodiments are in the form of an adjustable diameter hairbrush. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
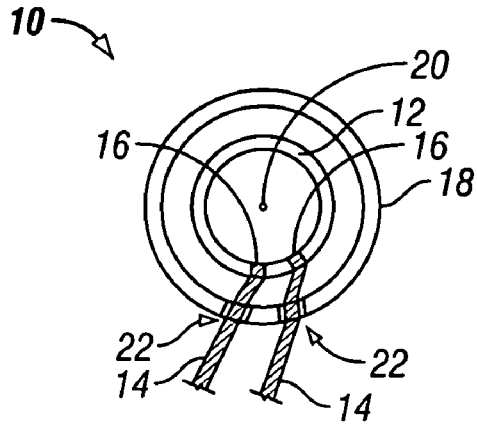
FIG. 1 is an end cross-sectional view of an embodiment of the present invention.
Figure 2:
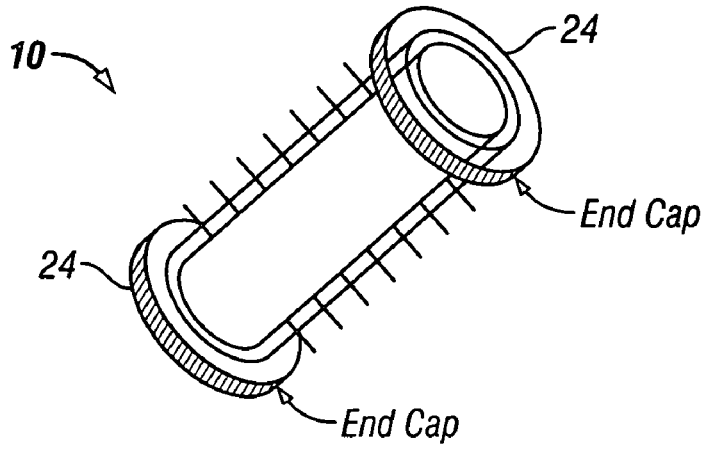
FIG. 2 is a front perspective view of an embodiment of the present invention.
Figure 3:
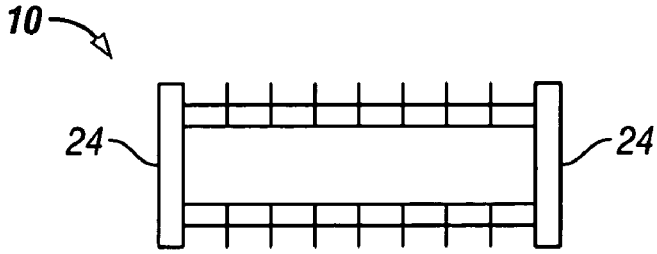
FIG. 3 is a front elevational view of an embodiment of the present invention.
Figure 4:
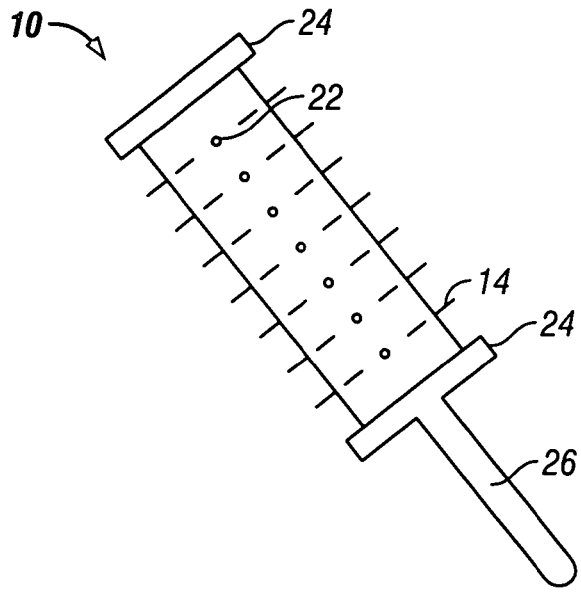
FIG. 4 is a front perspective view of an embodiment of the present invention.

A first implementation of an adjustable diameter cylindrical mechanism in accordance with the teachings of the present invention in the form of an adjustable hair brush as shown in FIGS. 1-7. In FIG. 1 an end cross-sectional view of hair brush 10 is shown. Hair brush 10 includes an inner retaining cylinder 12 to which brush bristles 14 are secured, preferably in clumps of several bristles at each location 16 at which they are secured. An outer cylinder 18 rotates coaxially about the inner retaining cylinder 12 and coaxial with axis 20. Bristles 14 are directed through apertures 22 in outer cylinder 18. As relative rotation occurs, the bristles 14 extend from and retract into the brush varying their apparent length and the amount that they protrude from outer cylinder 18. One or two end caps 24 are preferably affixed to the inner retaining cylinder 12 and incorporate a stop mechanism such as a conventional detent or similar mechanism well known in the art such as a pin 13 moving in a blocked track 15 of end cap 24 to limit rotation beyond a point where the bristles 14 would disengage, i.e., come out of, apertures 22 through which they are to remain threaded. A conventional handle 26 is also provided as shown in FIG. 4. Handle 26 may be coupled to inner retaining cylinder 12 so as to provide an easy mechanism for adjustment by rotating handle 26 with respect to end cap 24. One or two end caps 24 may be provided, as desired.

Figure 5:
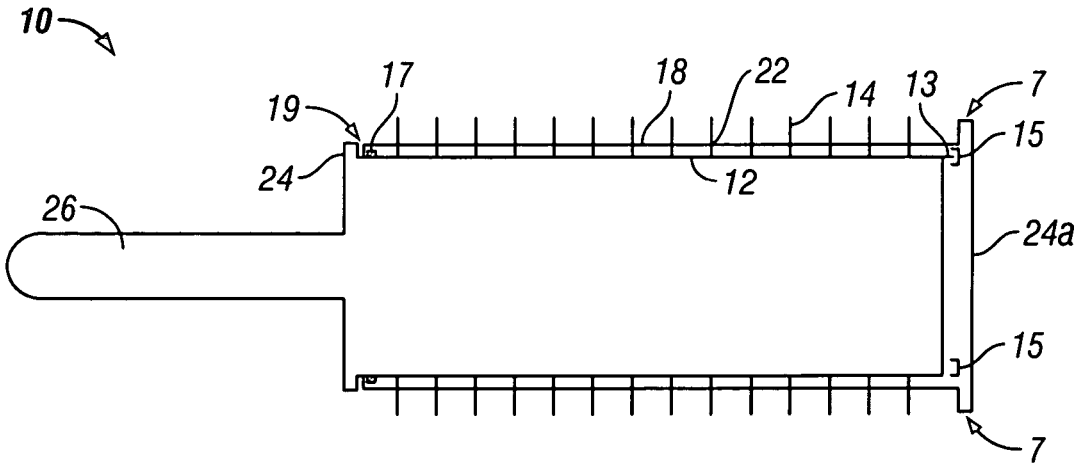
FIG. 5 is an elevational cross-section of a hair brush in accordance with an embodiment of the present invention.
Figure 7:
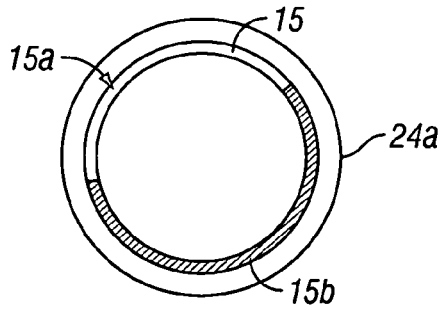
FIG. 7 is a cross-sectional view taken along line 7-7 of FIG. 5.
Figure 8:
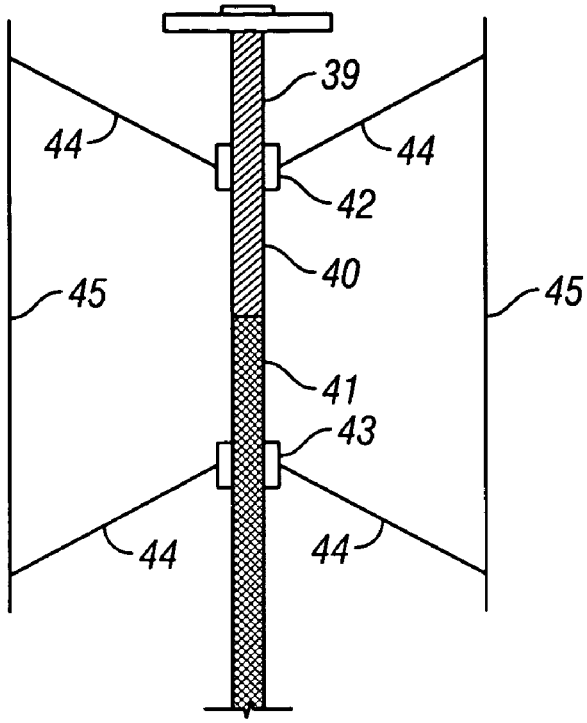
FIG. 8 is a side elevational view of a drive mechanism for an adjustable hair brush in accordance with an embodiment of the present invention.

FIGS. 5 and 7 illustrate one version of the hair brush in which pin 13 runs in a blocked track having a clear portion 15 a (FIG. 7) and a blocked portion 15*b*. End cap 24*a* may contain blocked track 15 and be coupled to outer cylinder 18. Handle 26 is coupled to inner cylinder 12. A ridge 17 holds end 19 of outer cylinder 18 engaged permitting relative rotation of inner retaining cylinder 12 and outer cylinder 18.

Figure 6:
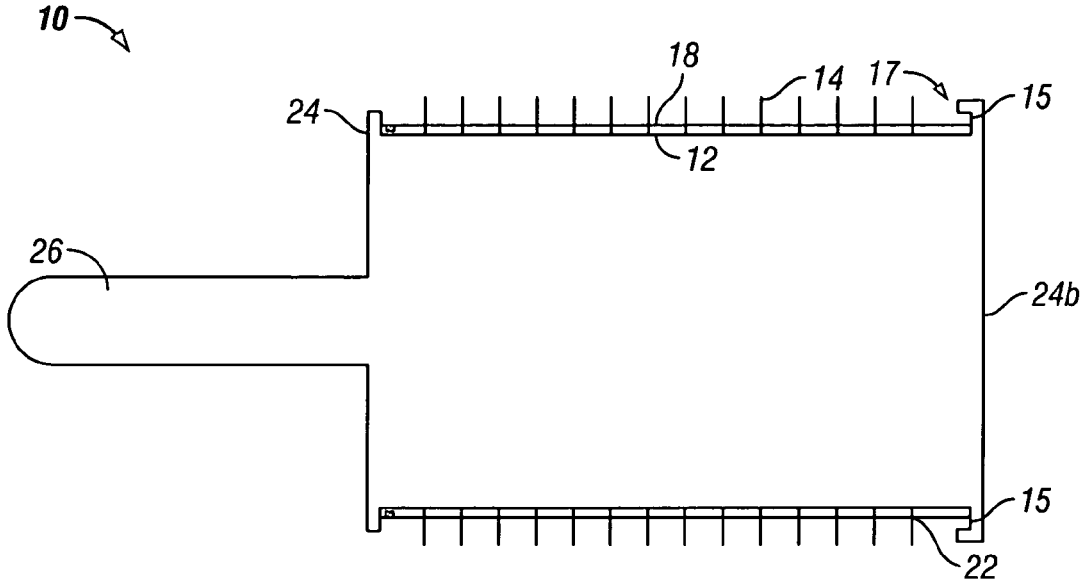
FIG. 6 is an elevational cross-section of a hair brush in accordance with an embodiment of the present invention.

FIG. 6 illustrates a slightly different embodiment where handle 26 is used to drive outer cylinder 18 and end cap 24*b* may contain a blocked track mechanism to limit relative rotation of inner retaining cylinder 12 and outer cylinder 18 as before where the end of outer cylinder 18 includes a pin or member 17 moving in an unblocked portion of blocked track 15.

A second implementation of an adjustable hair brush is illustrated in FIGS. 8-13. In one specific embodiment the apparatus includes a central rod with a threaded mechanism 39 having a first type of thread (e.g., a right-handed thread) along a first portion 40 thereof and opposite threading (e.g., a left-handed thread) along a second portion 41 thereof. In accordance with this specific embodiment, as the threaded mechanism 39 is rotated (e.g., clockwise), nuts 42 and 43 (if kept from rotating relative to threaded mechanism 39) will move apart from one another on the threaded mechanism 39. As threaded mechanism 39 is rotated in the opposite direction (e.g., counter-clockwise), nuts 42 and 43 (if similarly kept from rotating) will move toward one another. Linkages 44 are all hinged, both to nuts 42 or 43, as shown, and to outer cylinder portions 45. Outer cylinder portions 45 include bristles extending therefrom. As nut 42 and nut 43 approach one another, cylinder portions 45 come together, thus reducing the diameter of the hair brush. As nut 42 and nut 43 are moved away from one another, the diameter of the hair brush increases. It should be noted that while the threaded rod and nut mechanism is presently preferred, those of ordinary skill in the art will now realize that other similar mechanisms, such as those involving sliding movement along element 39 could also be used. In such a case element 39 need not be round, nor threaded.

Figure 9:
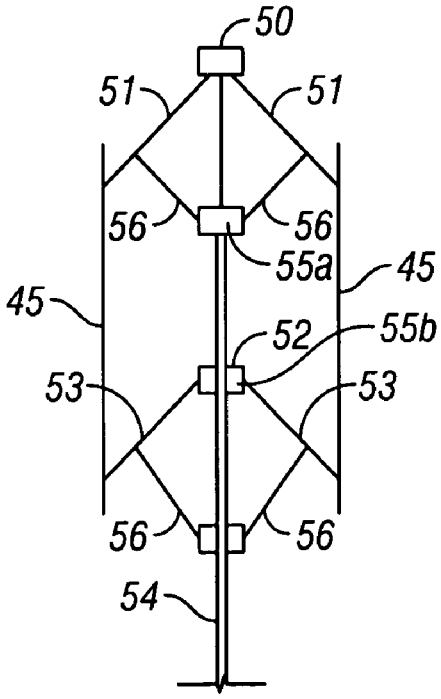
FIG. 9 is a side elevational view of a drive mechanism for an adjustable hair brush in accordance with an embodiment of the present invention.

In the implementation shown in FIG. 9, retaining point 50 may be thought of as fixed. Linkages 51 are hinged to point 50 (which may be implemented as a retaining ring disposed about an axis (such as that parallel to and coaxial with rod 54) of the device for constraining the movement of linkages 51 along the axis of the device) and extend therefrom to hingedly engage outer cylinder portions 45 as before. Retaining point 52 is fixed with respect to retaining point 50 along an axis of the device and may also be implemented as a retaining ring disposed about the axis of the device for constraining the movement of linkages 53 along the axis of the device. It is hingedly connected to outer cylinder portions 45 by linkages 53. As a connecting rod 54, which is coupled to a pair of drive points 55*a*, 55*b*, which are mutually linked, as by a rod, is moved in and out relative to retaining point 50, linkages 56 which may couple drive point 55*a* and/or drive point 55*b* to linkages 51 and 53, respectively, in turn cause outer cylinder portions 45 to move in and out in a radial direction with respect to the axis of the device by an action that is similar to the operation of a conventional umbrella. It should be noted that while the threaded rod and nut mechanism is presently preferred in this specific embodiment of the invention as well, those of ordinary skill in the art will now also realize that other similar mechanisms, such as those involving sliding movement along element 54 (as like the mechanism of an umbrella) could also be used. In such a case element 54 need not be round, nor threaded.

Figure 10:
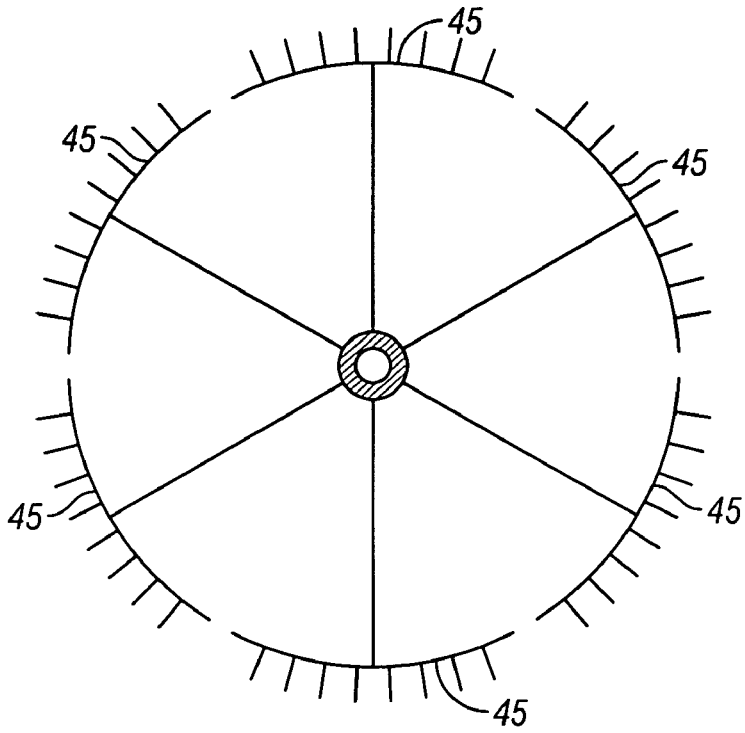
FIGS. 10 and 11 are view of a drive mechanism for an adjustable hair brush in accordance with an embodiment of the present invention.

FIG. 10. shows outer cylinder portions 45 extended.

Figure 11:
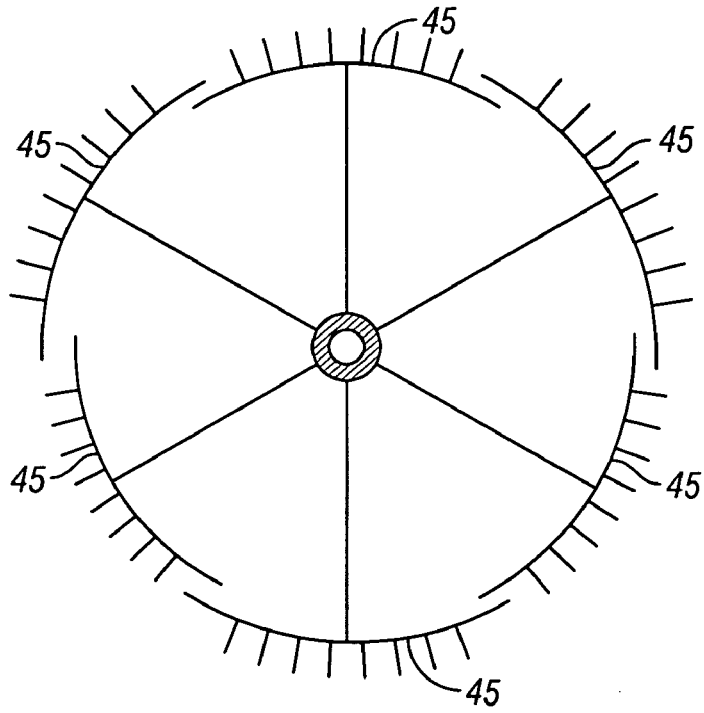

FIG. 11 shows outer cylinder portions retracted.

Figure 12:
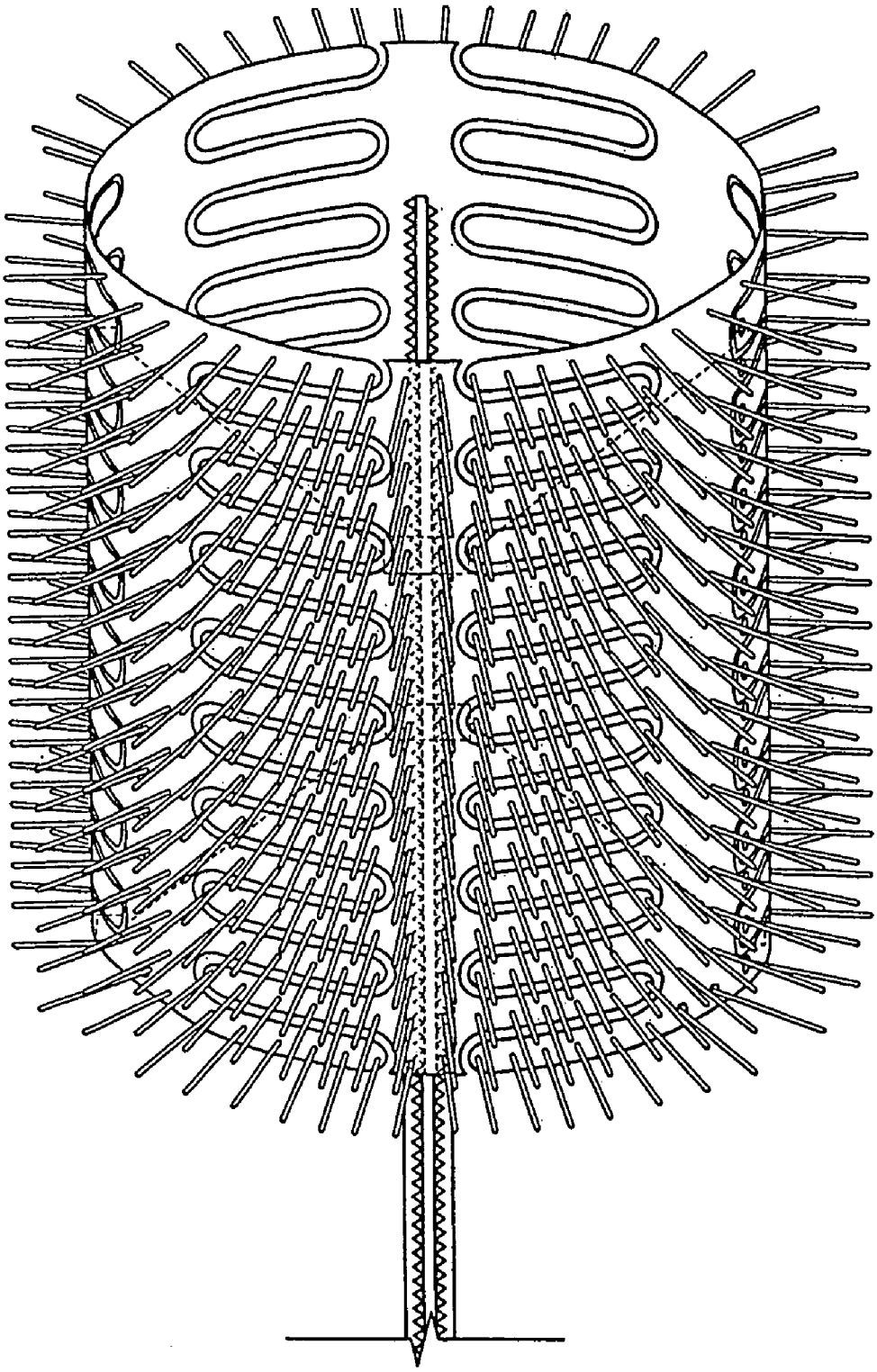
FIG. 12 is a perspective view of a drive mechanism for an adjustable hair brush in accordance with an embodiment of the present invention.

FIG. 12 shows a front perspective view of the apparatus.

Figure 13:
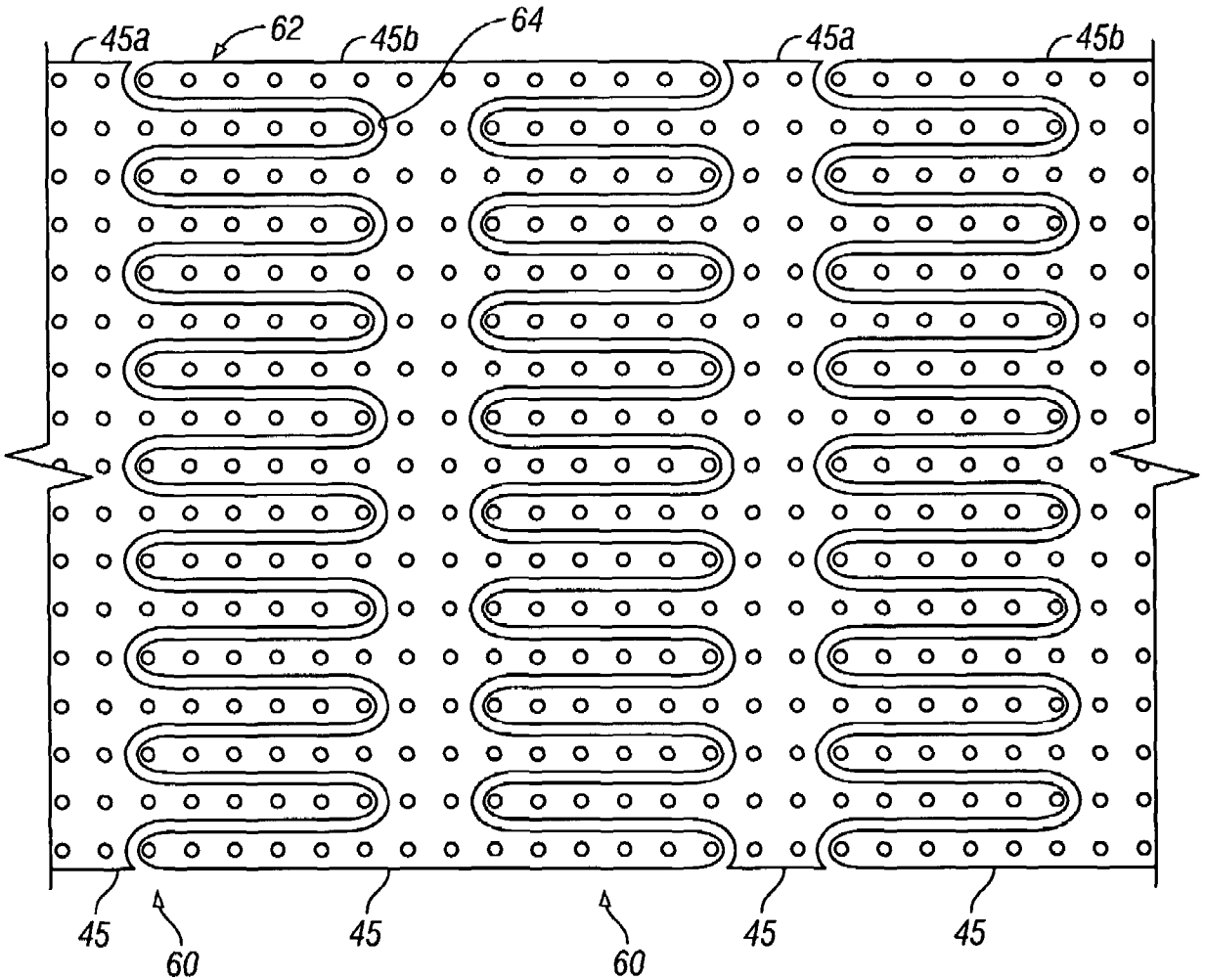
FIG. 13 is an elevational view of an outer cylinder portion of an adjustable hair brush in accordance with an embodiment of the present invention.

FIG. 13 shows how the outer cylinder portions 45 engage one another so that they do not substantially interfere with one another along the path from fully extended to fully retracted, and vice versa. In this case the outer cylinder portions are of two types, 45*a* and 45*b*, as shown, are interlock as shown. The outer cylinder portions each comprise a pair of engaging sides 60. Such engaging side comprises a series of tongues 62 and grooves 64 so that two adjacent engaging side 60 will engage respective tongues 62 with respective grooves 64.

Note that it is also within the scope of this invention to utilize the adjustable hair brush structure as follows:

1. for adjustable hair curlers (without the bristles and optionally with hook fasteners of hook and loop type fastening material on the outside of the cylinder to facilitate hair curling) of the heated and unheated types;

2. for an attachment to a blow dryer where hot air is blown in along the handle axis (the handle may be deleted in this embodiment and each end cap used to couple to are of the inner and outer cylinders or to the alternative drive mechanism) and out perpendicular to that axis.

While embodiments and applications of this invention have been shown and described, it would be apparent to those of ordinary skill in the art having the benefit of this disclosure that many more modifications than mentioned above are possible without departing from the inventive concepts herein. The invention, therefore, is not to be restricted except in the spirit of the appended claims.

What is claimed is:

1. An adjustable diameter mechanism, comprising:

a plurality of cylinder portions;

each said cylinder portion comprising an arcuate portion of a cylinder and extending along an arc less than or about 120 degrees of a 360 degree circle;

each said cylinder portion having a first engaging side and a second engaging side opposite said first engaging side;

each said engaging side including a plurality of alternating tongues and grooves arranged so that said tongues of a cylinder portion passes through said grooves of an adjacent cylinder portion without substantial interference as said cylinder portions engage one another;

a longitudinal axis oriented parallel to each of said cylinder portions;

means for simultaneously moving said plurality of cylinder portions along a direction orthogonal to said longitudinal axis; and means for maintaining said cylinder portions parallel to said longitudinal axis.

2. The apparatus of claim 1, wherein said moving means includes:

a rod disposed along said longitudinal axis.

3. The apparatus of claim 2, wherein said rod is threaded in one direction.

4. The apparatus of claim 1, wherein said moving means includes:

a threaded rod disposed along said longitudinal axis; and a threaded element riding on said threaded rod.

5. An adjustable diameter mechanism, comprising:

a plurality of cylinder portions disposed about a 360 degree circle;

each said cylinder portion comprising an arcuate portion of a cylinder and extending along an arc less than or about 120 degrees of said 360 degree circle;

each said cylinder portion having a first engaging side and a second engaging side opposite said first engaging side;

each said engaging side including a plurality of alternating tongues and grooves arranged so that said tongues of a cylinder portion passes through said grooves of an adjacent cylinder portion without substantial interference as said cylinder portions engage one another;

a longitudinal axis oriented parallel to each of said cylinder portions;

means for simultaneously moving said plurality of cylinder portions along a direction orthogonal to said longitudinal axis;

means for maintaining said cylinder portions parallel to said longitudinal axis; and a handle coupled to said moving means so that rotation of said handle with respect to said cylinder portions activates said moving means.

6. An adjustable diameter mechanism, comprising:

a plurality of cylinder portions;

each said cylinder portion comprising an arcuate portion of a cylinder and extending along an arc less than or about 120 degrees of a 360 degree circle;

each said cylinder portion having a first engaging side and a second engaging side opposite said first engaging side;

each said engaging side including a plurality of alternating tongues and grooves arranged so that said tongues of a cylinder portion passes through said grooves of an adjacent cylinder portion without substantial interference as said cylinder portions engage one another;

a longitudinal axis oriented parallel to each of said cylinder portions;

means for simultaneously moving said plurality of cylinder portions along a direction orthogonal to said longitudinal axis;

means for maintaining said cylinder portions parallel to said longitudinal axis;

wherein said moving means includes:

a rod disposed along said longitudinal axis; and wherein said rod is threaded in two directions.

7. An adjustable diameter mechanism, comprising:

a plurality of cylinder portions;

each said cylinder portion comprising an arcuate portion of a cylinder and extending along an arc less than or about 120 degrees of a 360 degree circle;

each said cylinder portion having a first engaging side and a second engaging side opposite said first engaging side;

each said engaging side including a plurality of alternating tongues and grooves arranged so that said tongues of a cylinder portion passes through said grooves of an adjacent cylinder portion without substantial interference as said cylinder portions engage one another;

a longitudinal axis oriented parallel to each of said cylinder portions;

means for simultaneously moving said plurality of cylinder portions along a direction orthogonal to said longitudinal axis;

means for maintaining said cylinder portions parallel to said longitudinal axis; and wherein said moving means includes:

a threaded rod; and a pair of threaded elements riding on said threaded rod.

8. The apparatus of claim 7, wherein said maintaining means includes:

a pair of members associated with each cylinder portion, each said member having a first end hingedly coupled to one of said cylinder portions and a second end coupled to one of said threaded elements.

9. The apparatus of claim 8, wherein said threaded rod includes a first right-handed thread portion and a second left-handed thread portion.

10. An adjustable diameter mechanism, comprising:

a plurality of cylinder portions;

each said cylinder portion comprising an arcuate portion of a cylinder and extending along an arc less than or about 120 degrees of a 360 degree circle;

each said cylinder portion having a first engaging side and a second engaging side opposite said first engaging side;

each said engaging side including a plurality of alternating tongues and grooves arranged so that said tongues of a cylinder portion passes through said grooves of an adjacent cylinder portion without substantial interference as said cylinder portions engage one another;

a longitudinal axis oriented parallel to each of said cylinder portions;

means for simultaneously moving said plurality of cylinder portions along a direction orthogonal to said longitudinal axis;

means for maintaining said cylinder portions parallel to said longitudinal axis; and wherein:

said moving means includes:

a threaded rod disposed along said longitudinal axis; and a threaded element riding on said threaded rod; and said maintaining means includes:

a pair of members associated with each cylinder portion, each said member having a first end hingedly coupled to a different location on an inner surface of one of said cylinder portions and a second end hingedly coupled to a fixed position along said longitudinal axis.

11. The apparatus of claim 10, wherein said moving means further includes:

for each of said members, a coupling having a first coupling end hingedly coupled to said member at a point mediate said first end and said second end thereof and a second coupling end coupled to and driven by said threaded element.

12. An adjustable diameter mechanism, comprising:

a plurality of cylinder portions;

each said cylinder portion comprising an arcuate portion of a cylinder and extending along an arc less than or about 120 degrees of a 360 degree circle;

each said cylinder portion having a first engaging side and a second engaging side opposite said first engaging side;

each said engaging side including a plurality of alternating tongues and grooves arranged so that said tongues of a cylinder portion passes through said grooves of an adjacent cylinder portion without substantial interference as said cylinder portions engage one another;

a longitudinal axis oriented parallel to each of said cylinder portions;

means for simultaneously moving said plurality of cylinder portions along a direction orthogonal to said longitudinal axis;

means for maintaining said cylinder portions parallel to said longitudinal axis; and wherein a plurality of bristles are attached to each of said tongues.

13. The apparatus of claim 12, wherein said plurality of bristles which are attached to each of said tongues are located so that when said cylinder portions are moved along a direction orthogonal to said longitudinal axis and said tongues pass through said grooves, said bristles of a tongue do not contact a tongue of an adjacent cylinder portion.

* * * * *